US009605368B2

(12) United States Patent
Shu et al.

(10) Patent No.: US 9,605,368 B2
(45) Date of Patent: Mar. 28, 2017

(54) SELF-CLEANING WASHING MACHINE AND CONTROL METHOD THEREOF

(71) Applicants: HAIER GROUP CORPORATION, Qingdao, Shandong (CN); QINGDAO HAIER WASHING MACHINE CO., LTD., Qingdao, Shandong (CN)

(72) Inventors: Hai Shu, Shandong (CN); Peishi Lv, Shandong (CN); Sheng Xu, Shandong (CN)

(73) Assignees: HAIER GROUP CORPORATION, Qingdao, Shandong (CN); QINGDAO HAIER WASHING MACHINE CO., LTD., Qingdao, Shandong (CN)

( * ) Notice: Subject to any disclaimer, the term of this patent is extended or adjusted under 35 U.S.C. 154(b) by 0 days.

(21) Appl. No.: 14/559,679

(22) Filed: Dec. 3, 2014

(65) Prior Publication Data

US 2015/0096333 A1 Apr. 9, 2015

Related U.S. Application Data

(63) Continuation of application No. PCT/CN2012/084714, filed on Nov. 16, 2012.

(30) Foreign Application Priority Data

Jun. 8, 2012 (CN) ..... 2012 1 0188593
Jun. 8, 2012 (CN) ..... 2012 1 0188601
(Continued)

(51) Int. Cl.
*D06F 35/00* (2006.01)
*D06F 39/10* (2006.01)
(Continued)

(52) U.S. Cl.
CPC ..... *D06F 35/008* (2013.01); *D06F 23/04* (2013.01); *D06F 33/02* (2013.01); *D06F 37/12* (2013.01);
(Continued)

(58) Field of Classification Search
CPC ..... D06F 35/008; D06F 23/04; D06F 33/02; D06F 37/12; D06F 37/264; D06F 37/267; D06F 39/083; D06F 39/10
(Continued)

(56) References Cited

U.S. PATENT DOCUMENTS 1,337,517 A * 4/1920 Izquierdo ..... B01D 23/00 210/318
2006/0179897 A1* 8/2006 Saito ..... D06F 37/04 68/23 R
(Continued)

FOREIGN PATENT DOCUMENTS

CN 201358374 Y 12/2009
CN 102154804 A * 8/2011 ..... D06F 39/08
(Continued)

OTHER PUBLICATIONS

International Search Report dated Feb. 21, 2013 for Application No. PCT/CN2012/084714.

*Primary Examiner* — Karla Moore
*Assistant Examiner* — Tinsae Ayalew
(74) *Attorney, Agent, or Firm* — Tim Tingkang Xia, Esq.; Locke Lord LLP

(57) ABSTRACT

Disclosed are a self-cleaning washing machine and a control method thereof. The washing machine includes inner and outer drums defining a chamber therebetween, a wave wheel, a water drainage apparatus, cleaning pellets provided in the chamber for cleaning drum walls between the inner and outer drums, and an isolating structure for preventing
(Continued)

the cleaning pellets from escaping from the chamber. The isolating structure includes a filtration mechanism arranged in the water drainage apparatus to prevent the cleaning pellets from being flushed away when water is drained, and/or a grid mechanism arranged at the bottom of the inner drum to prevent the cleaning pellets from entering the inner drum. Operably, in the water-draining and/or spin-dry process, the inner drum is controlled to carry out different actions, making the cleaning pellets together with the water flow through a water drainage opening to be collected by a water drainage valve.

21 Claims, 11 Drawing Sheets

(30) Foreign Application Priority Data

Jun. 8, 2012 (CN) ..... 2012 1 0188605
Jun. 8, 2012 (CN) ..... 2012 1 0188729

(51) Int. Cl.
*D06F 33/02* (2006.01)
*D06F 37/26* (2006.01)
*D06F 39/08* (2006.01)
*D06F 23/04* (2006.01)
*D06F 37/12* (2006.01)

(52) U.S. Cl.
CPC ..... *D06F 37/264* (2013.01); *D06F 37/267* (2013.01); *D06F 39/083* (2013.01); *D06F 39/10* (2013.01)

(58) Field of Classification Search
USPC ..... 68/23.6, 13 R; 134/7
See application file for complete search history.

(56) References Cited

U.S. PATENT DOCUMENTS

2010/0058816 A1* 3/2010 Choi ..... D06F 37/26 68/139
2010/0281926 A1* 11/2010 Seo ..... D06F 17/10 68/132

FOREIGN PATENT DOCUMENTS

| | | | |
|---|---|---|---|
| CN | 102234902 | A | 11/2011 |
| CN | 102733145 | A | 10/2012 |
| CN | 102733146 | A | 10/2012 |
| CN | 102733156 | A | 10/2012 |
| KR | 101037967 | B1 | 5/2011 |

* cited by examiner

SELF-CLEANING WASHING MACHINE AND CONTROL METHOD THEREOF

CROSS-REFERENCE TO RELATED APPLICATIONS

This application is a continuation application of PCT Patent Application No. PCT/CN2012/084714, filed Nov. 16, 2012, which itself claims priority to Chinese Patent Application Nos. 201210188729.7, 201210188605.9, 201210188601.0 and 201210188593.X. All of the Chinese Patent Applications were filed Jun. 8, 2012 in the State Intellectual Property Office of P.R. China. Each of the above disclosures is incorporated herein in its entirety by reference.

FIELD OF THE INVENTION

The present invention relates generally to washing machines, and more particularly, to a self-cleaning washing machine in which drum walls between inner and outer drums are automatically cleaned with water flow by using cleaning pellets, and a control method thereof for collecting cleaning pellets.

BACKGROUND OF THE INVENTION

The background description provided herein is for the purpose of generally presenting the context of the present invention. The subject matter discussed in the background of the invention section should not be assumed to be prior art merely as a result of its mention in the background of the invention section. Similarly, a problem mentioned in the background of the invention section or associated with the subject matter of the background of the invention section should not be assumed to have been previously recognized in the prior art. The subject matter in the background of the invention section merely represents different approaches, which in and of themselves may also be inventions. Work of the presently named inventors, to the extent it is described in the background of the invention section, as well as aspects of the description that may not otherwise qualify as prior art at the time of filing, are neither expressly nor impliedly admitted as prior art against the present invention.

In existing wave wheel washing machines, the environment between inner and outer drums is closed, and only water can flow therein. Due to the limitation of the washing machine structure and the particularity of the user environment, dirt adheres to the outer wall of the inner drum and the inner wall of the outer drum after 3 to 5 months of use. Consequently, bacteria will breed in different extents, most of which are harmful to human body.

As people's living standards and the requirements of living quality increase, a solution to the sanitation of washing machines seems to be urgent. A survey conducted by a related scientific research institution on the internal environment of washing machines shows that consumers have started paying more and more attention to the severity of internal contamination of washing machines. To fundamentally prevent washing machines from bringing second-time dirt to the laundry and to be more responsible for users' health, the cleaning issue of the internal environment of washing machines needs to be addressed immediately.

Chinese Patent No. 200820183308.4 discloses a sleeve washing machine with walls between the drums cleaned. The washing machine includes an inner drum, an outer drum, and multiple circular silicone balls for cleaning the walls between the inner and outer drums. During washing, the inner drum rotates to drive the water to flow, thereby driving the silicone balls between the inner drum and outer drum of the washing machine to move and continuously collide with the walls between the inner and outer drums, so as to achieve the objective of cleaning the walls between the inner and outer drums.

By using the washing machine structure as described above, however, rubber balls or soft pellets are freely scattered in the drum after water drainage, which causes big noises during the high speed dewatering process, and also increases energy consumption and affects the service life of the washing machine.

In addition, Chinese Application No. 201010160548.4 discloses a washing machine using soft pellets to clean the environment between inner and outer drums of the washing machine and a method thereof. In the washing machine, soft pellets are placed between the inner and outer drums of the washing machine, and when laundry is washed, water flows regularly to drive the soft pellets to collide and rub the walls between the inner and outer drums of the washing machine, so as to clean the environment between the inner and outer drums of the washing machine.

By using the washing machine structure as described above, however, to strengthen the bottom of the inner drum, many reinforcing ribs are distributed at the bottom of the inner drum. The reinforcing ribs divide the external part of the bottom of the inner drum into multiple small grooves. The closer the grooves are to the center of the inner drum, the smaller the grooves are. Because the gap between the bottom of the inner drum and the bottom of the outer drum is small, it is difficult for water to flush between the bottoms of the inner and outer drums after long term use, and a lot of dirt is accumulated and hard to get rid of. Such bottom structure of the inner drum is not suitable for a washing machine with cleaning pellets for the following reasons: firstly, the reinforcing ribs at the bottom of the inner drum are high and the gap between the bottom of the inner drum and the bottom of the outer drum is small, thus it is not easy for cleaning pellets to enter the space between the bottoms of the inner and outer drums. Even though a few pellets could get in with the water flow, they are easily clamped or confined in the grooves and cannot get out, and the pellets between the inner and outer drums will be reduced in quantity, affecting the normal cleaning function of the drum walls. Secondly, because the reinforcing ribs are densely distributed and grooves are small, motions of the cleaning pellets that have entered the space between the bottoms of the inner and outer drums with the water flow fail to provide sufficient acceleration in the small grooves for the pellets to collide with the drum walls to clean the drum walls.

Therefore, a heretofore unaddressed need exists in the art to address the aforementioned deficiencies and inadequacies.

SUMMARY OF THE INVENTION

One of the objectives of the present invention is to provide a self-cleaning washing machine with cleaning pellets provide in a chamber defined between the inner and outer drums to perform a drum wall cleaning function so as to solve the foregoing problems and disadvantages.

In one aspect, the present invention relates to a self-cleaning washing machine having an isolating structure for preventing the cleaning pellets from escaping from the chamber between the inner and outer drums.

In another aspect, the present invention relates to a control method for the self-cleaning washing machine to collect the cleaning pellets.

In one embodiment, the self-cleaning washing machine comprises an outer drum, an inner drum, a wave wheel and a water drainage apparatus, wherein a chamber defined between the inner drum and the outer drum is provided with cleaning pellets for cleaning an inner wall of the outer drum and an outer wall of the inner drum. The washing machine also includes an isolating structure for preventing the cleaning pellets from escaping from the chamber. In one embodiment, the isolating structure includes a filtration mechanism arranged in the water drainage apparatus to prevent the cleaning pellets from being flushed away when water is drained, and/or a grid mechanism arranged at the bottom part of the inner drum to prevent the cleaning pellets from entering the inner drum from the bottom of the inner drum.

In one embodiment, the isolating structure further includes a filtration grid arranged at a water overflow port of the outer drum to prevent the cleaning pellets from being flushed with overflowing water. The filtration grid and the outer drum are integrated by injection molding, or are a separable plug-and-pull structure where slots are set up at two sides of the water overflow port and the filtration grid is inserted in the slots, or are a snap-on structure.

In one embodiment, the filtration grid includes a frame matching the water overflow port and stopping ribs arranged in the frame. In certain embodiments, the stopping ribs are divided into two groups, a partition gap smaller than the cleaning pellet is defined between the two groups of stopping ribs, a gap smaller than the cleaning pellet is defined between two adjacent stopping ribs in the same group, and the two groups of stopping ribs corresponding to a filtration surface formed at an inner side of the outer drum is a cambered surface toward, at a position of the partition gap, the other side along a direction of a stopping rib or an inclined surface. In certain embodiments, the two groups of stopping ribs are arranged symmetrically or are arranged with alternate extension directions. In certain embodiments, the filtration grid is a horizontal grid structure, or a vertical grid structure, or a screen structure.

In certain embodiments, the isolating structure further includes an outer drum cover arranged at the top part of the outer drum to cover an annular opening of the chamber, corresponding to the annular opening. The outer drum cover is provided with a pellet inlet for supplementing cleaning pellets to the chamber; in certain embodiments. The pellet inlet is provided with a cover that can be opened or closed.

In certain embodiments, the wave wheel is a self-cleaning wave wheel, including a wave plate and a water stirring piece arranged on an upper surface of the wave plate. In certain embodiments, the top part of the water stirring piece is provided with at least one water permeable hole, which corresponds to and communicates with a groove space of the bottom part of the water stirring piece. Multiple water permeable holes are distributed on the water stirring piece along the circumference close to the edge of the wave plate, and at least two water permeable holes are distributed on the water stirring piece along a radial direction at one end close to the center of the wave wheel.

In certain embodiments, a lower surface of the wave plate has multiple groove spaces formed by reinforcing ribs of the wave plate, corresponding to the area beyond the range of the water stirring piece, each groove space is provided with at least one water permeable hole to form flushing water flowing above and below the groove space.

In one embodiment, at least two rubbing bulges are arranged between each two water stirring pieces at the edge of the basin-shaped wave wheel, which are evenly distributed along the circumference of the wave wheel.

In one embodiment, an antimicrobial mildew proof coat is covered on the lower surface of the wave plate.

In one embodiment, the water drainage apparatus is provided in the self-cleaning washing machine such that cleaning pellets are collected by using draining water during water drainage and dewatering to avoid noise caused by the cleaning pellets colliding with the drum walls in between the inner and outer drums during dewatering, and at the same time, lint, sheet-like objects such as coins and buttons, and other sundries smaller than the cleaning pellets are smoothly discharged, thereby avoiding blockage.

In certain embodiments, the water drainage apparatus includes a pellet receiving chamber for collecting the cleaning pellets during dewatering and floating the cleaning pellets under the buoyant force during the water feeding to clean the drum walls, and a water drainage chamber. The filtration mechanism is arranged between the pellet receiving chamber and the water drainage chamber. The filtration mechanism can not only prevent the cleaning pellets from being discharged, but also provide lint and sundries smaller than the cleaning pellets from being discharged.

In certain embodiments, the filtration mechanism includes multiple stopping ribs to prevent the cleaning pellets, which are divided into two groups by a notch having a width smaller than the cleaning pellets, and a filtration gap smaller than the cleaning pellets is defined between the two adjacent stopping ribs in the same group. The two groups of stopping ribs correspond to a filtration surface formed at one side of the pellet receiving chamber, which is a cambered surface towards, at a position of the notch, the other side or an inclined surface, and the filtration surface is V-shaped with the bottom part opened or trapezoidal-shaped with an upper base longer than the lower base. The notch can not only enable the lint twined on a stopping rib to slide to a tail end of the stopping rib and pass through the notch, but also enable sheet-like objects such as buttons and coins to pass, thereby further reducing the possibility of lint blockage.

In certain embodiments, the notch separates the stopping ribs into two oppositely arranged comb structures, where the extension lines of stopping ribs of the two comb structures are alternate. The structure with the alternate extension lines of stopping ribs enables the passing of the cleaning pellets still be prevented even though the cleaning pellets are fixed in size and the distance between the two adjacent stopping ribs is increased, thereby further reducing the possibility of lint blockage.

In certain embodiments, the two comb structures are arranged oppositely in an up-down or a left-right manner, with a horizontal or vertical notch defined therebetween. The extension lines of stopping ribs of one comb structure are vertically alternated with those of stopping ribs of the other comb structure. The stopping ribs of the two comb structures are parallel to each other, and the spacing between each two adjacent straight lines is the same. End parts of three stopping ribs, adjacent to each other, of the two comb structures form a pellet stopping part of the notch at the triangular area. Tests have found out that compared with the comb structure with upper stopping ribs and lower stopping ribs symmetrically arranged, under the condition that the cleaning pellets and the notch are all fixed in sizes, the distance between the two adjacent stopping ribs of each comb structure can be larger while the passing of the cleaning pellets still be prevented.

In certain embodiments, the water drainage apparatus is arranged below the outer drum, a through port that communicates with a water drainage port at the bottom of the outer drum is arranged on an upper wall of the pellet receiving chamber, and the upper wall of the pellet receiving chamber inclines upward from the periphery to the through port. The inclining direction enables the cleaning pellets to rise with the water level and flow to the through port, and further enter the chamber between the inner and outer drums through the water drainage port. During the water drainage and dewatering processes, the cleaning pellets enter the pellet receiving chamber with the draining water flow. When water is fed again, the cleaning pellets float with the rise of the water level of the pellet receiving chamber, and the cleaning pellets move along the inclining direction, that is, move upward in an inclining manner, to enter the through port more conveniently, and then enter the space between the inner and outer drums through the water drainage port.

In certain embodiments, an opening communicating with outside is arranged at one side of the pellet receiving chamber opposite to the water drainage chamber, with a sealing cover that can be opened or closed, and a circumferential inner wall of the sealing cover is in a conical frustum circumferential wall structure with an aperture gradually enlarged in a direction toward inside of the pellet receiving chamber.

The structure according to this embodiment, when water is fed to the washing machine for the next time, the cleaning pellets can be released in between the inner and outer drums again under the buoyant force of the fed water to continue to clean the drum walls, and the adopted inclined inner wall structure makes it easier to reuse the cleaning pellets, and avoids blockage caused by failure of the cleaning pellets floating upward. The structure according to this embodiment is simple, and the manufacturing and mounting costs are low.

In certain embodiments, a grid mechanism for preventing the cleaning pellets from entering the inner drum from the bottom of the inner drum includes a stop cover that matches a flange plate to prevent the cleaning pellets from entering the inner drum from a hollow area of the bottom of the inner drum. The stop cover has water through holes capable of preventing cleaning pellets from passing.

In certain embodiments, the stop cover comprises a donut-like annular cover body defining a hollow region therein. The main body of the flange plate correspondingly blocks the hollow region of the stop cover. The diameter of the main body of the flange plate is d, the diameter of the hollow area of the bottom part of the inner drum is D, the inner diameter of the stop cover is d1, the outer diameter of the stop cover is d2, which satisfy with $d1 \leq d < D \leq d2$, or $d1 \leq d < d2 < D$. The difference between the inner diameter D of the hollow area of the bottom part of the inner drum and the outer diameter d2 of the stop cover satisfies that the cleaning pellets are incapable of passing through the gap between the edge of the hollow area of the bottom part of the inner drum and the periphery of the stop cover.

In certain embodiments, the stop cover is an independent structure clamped or adhered between the bottom of the inner drum and the flange plate, or is integrated with the bottom of the inner drum, or is integrated with the flange plate, or is integrated with the bottom of the inner drum and the flange plate. The stop cover can prevent the cleaning pellets between the inner and outer drums from entering the inner drum, thereby preventing quantity reduction of the cleaning pellets between the inner and outer drums from affecting the drum wall cleaning.

In certain embodiments, each water through hole is a straight elongated slit structure or a bent elongated slit structure. Because most lint in washing water is collected by a lint filtration structure, and only a little lint is left and distributed as thin strips, the water through hole will not cause lint blockage.

In certain embodiments, each water through hole is a funnel structure with the size shrinking from up to down. Foreign bodies such as coins and buttons can pass through the structure, thereby reducing the possibility of blockage while preventing the cleaning pellets from entering the inner drum therefrom.

In certain embodiments, multiple grooves formed by reinforcing ribs at the bottom of the inner drum in a surrounding manner are provided outside the drum bottom, the gap between the bottom part of the reinforcing rib and the bottom of the outer drum is larger than that of the cleaning pellet. The grooves formed by reinforcing ribs at the drum bottom in a surrounding manner is capable of receiving at least about 2 cleaning pellets and preferably receiving about 2 to about 5 cleaning pellets. Each groove is accessible to the cleaning pellets, so that the cleaning pellets can move with water flow to obtain acceleration to collide with and rub the drum walls between the inner and outer drums.

In certain embodiments, the grooves include large grooves formed by reinforcing ribs outside the drum bottom in a surrounding manner and small grooves formed by division of reinforcing ribs inside the drum bottom, with the reinforcing ribs outside the drum bottom higher than the reinforcing ribs inside the drum bottom, and the reinforcing ribs inside the drum bottom no higher than about 5 mm. In certain preferable embodiments, corresponding to each groove, at least one water permeable through hole is added to the bottom of the inner drum, which not only reduces dirt adhered on the walls between the inner and outer drums, but also improves the mobility of the cleaning pellets, thereby preventing the cleaning pellets from being clamped at the bottom of the inner drum.

In certain embodiments, the cleaning pellets can float in the water, flows between the inner and outer drums of the washing machine with water flow to impact the walls of the inner and outer drums, in a laundry washing process, water flow drives the cleaning pellets to collide with and rub the walls of the inner and outer drums to clean the drum walls between the inner and outer drums of the washing machine. And after cleaning, washing water is drained from the water drainage apparatus, and the cleaning pellets flow to the pellet receiving chamber with the draining water and are received in the pellet receiving chamber; and when water is fed for rinsing or for washing the next time, with rise of the water level of the fed water, the cleaning pellets flow out of the pellet receiving chamber from the water drainage port and flows into the outer drum.

Utilizing the cleaning pellets between the inner and outer drums to clean walls of the inner and outer drums is the same as that washed objects in the inner drum rubs the inner drum so that the inner drum has no dirt adhered thereon and no bacteria breeding thereon. The cleaning pellets may be sponge typed objects, or may also be rubber or plastic foamed objects, such as foamed rubber, foamed plastic, or foamed composite polyurethane. In certain embodiments, an absorptive material is used so that better drum wall cleaning effects can be achieved. The cleaning pellets should have certain elasticity, have a smaller density than water when dry, have a soakage feature in water, and cheap. After multiple uses, cleaning pellets can be taken out by opening the sealing cover of an opening of a storage chamber and recycled, and then new cleaning pellets can be used.

In certain embodiments, the cleaning pellets are ball-shaped, block-shaped, ellipsoid-shaped, cylinder-shaped, or regular tetrahedron-shaped, or are other irregular mass-like pellet matters, with a quantity of about 3 to about 50. These pellets have a density smaller than water, and have certain elasticity and abrasive resistance.

In another aspect, the present invention further provides a control method for the self-cleaning washing machine to collect cleaning pellets by using draining water during water drainage and dewatering. The method is simple, capable of fully collection of the pellets, and eliminating noises caused by the cleaning pellets from colliding with inner and outer drums during dewatering.

In certain embodiments, in a water-draining and/or a spin-dry process, an inner drum is controlled to carry out different actions, so that the cleaning pellets could flow through a water drainage port with washing water, and are collected by a water drainage valve.

In certain embodiments, during the process of draining water, the inner drum is controlled to rotate at a low speed of about 5 to about 50 rpm, so that the cleaning pellets clamped between walls of the inner and outer drums could fall in between the inner and outer drums, and flow through the water drainage port with water in the outer drum, and are collected by the water drainage valve.

In certain embodiments, during the spin-dry process, the inner drum is controlled to carry out at least one braking action so that the cleaning pellets clamped between the walls of the inner and outer drums could fall into the space in between the inner and outer drums, and flow through the water drainage port with water thrown from laundry, and are collected by the water drainage valve.

In certain embodiments, the spin-dry process includes spinning laundry at a medium speed so that water flushes the cleaning pellets, at least one high speed spin-drying and braking, and spin-drying at a highest rotational speed until the end, where time allocated for each action in the stage is determined according to the total time of the spin-dry process.

In certain embodiments, in the spin-dry process, water is fed for a set time to increase the flushing water flow, and to assist the cleaning pellets to flow through the water drainage port and enter the water drainage valve. The spin-dry stage includes the following steps:

(a) after water drainage, the inner drum spinning the laundry at a medium speed for about 10 to about 60 seconds, or repeating the actions for about 2 to about 8 times according to a rule of rotating at a medium speed for about 2 to about 5 seconds and stopping for about 5 to about 15 seconds, to throw most water out of the laundry, to flush the pellets left at the bottom of the outer drum to the water drainage valve;

(b) the inner drum stopping in about 10 to about 20 seconds after accelerating to a high speed to shake off the pellets clamped at the bottom of the inner drum;

(c) repeating step (b) for about 1 to about 6 times; and (d) spin-drying at a highest rotational speed until the end.

If the amount of the washed laundry is lower than a set value, step (c) is replaced by feeding water for about 5 to about 15 seconds, repeating step (a), and then repeating step (b).

In certain embodiments, during the spin-dry process, the medium speed is in a range of about 200 to about 500 rpm, the high speed is in a range of about 500 to about700 rpm, and the highest rotation speed is in a range of about 700 to about1600 rpm.

Among other things, the present invention has the following beneficial effects.

In the self-cleaning washing machine, in one embodiment, the cleaning pellets for cleaning drum walls are placed in a chamber defined between the inner and outer drums. The isolating structure for preventing the cleaning pellets from escaping from the chamber is further provided, which includes a filtration mechanism that prevents the cleaning pellets from being flushed away when water is drained, and/or a grid mechanism arranged at the bottom of the inner drum to prevent the cleaning pellets from entering the inner drum from the bottom of the inner drum, and/or a filtration grid arranged at a water overflow port of the outer drum to prevent the cleaning pellets from flowing out with overflow water. The structure is simple and can effectively prevent the cleaning pellets from escaping from the chamber.

The water drainage apparatus in one embodiment is related to the washing machine with the cleaning pellets disposed between the inner and outer drums to perform the function of cleaning walls of the inner and outer drums. The cleaning pellets can be collected during water drainage to avoid noises caused by the cleaning pellets colliding with the drum walls between the inner and outer drums during dewatering, and the cleaning pellets can flow out of the pellet receiving chamber to the outer drum again under the buoyant force during water feeding, to continue to clean the drum walls. The water drainage apparatus is simple in structure and low in cost, and does not affect discharging of lint when stopping and collecting the cleaning pellets, thereby avoiding bacteria breeding caused by blockage of drained water and residual lint.

In one embodiment, the grooves from which the cleaning pellets can enter to move with the water flow to clean walls between the bottoms of the inner and outer drums are provided outside the bottom of the inner drum, so that the cleaning pellets between the inner and outer drums can clean the walls between the bottoms of the inner and outer drums. The structure is simple, and in the injection molding process of the bottom of the inner drum, modifications made to the design and distribution of reinforcing ribs provide space between the bottom parts of the inner and outer drums for the cleaning pellets to move with water flow. No additional material cost is added, and also the strength of the inner drum is not reduced.

In one embodiment, the stop cover is mounted on the bottom part of the inner drum, which can prevent the cleaning pellets of the chamber between the inner and outer drums from entering the inner drum through the bottom part of the inner drum, and prevent quantity reduction of the cleaning pellets between the inner and outer drums from affecting the cleaning effects of the outer wall of the inner drum and the inner wall of the outer drum. The water through hole distributed on the stop cover does not affect the flow of the washing water between the inner drum and the outer drum, and will not be blocked by lint. The structure is simple, and the cost is low.

In one embodiment, during the washing process, since the wave wheel or the inner drum continuously rotate in forward and backward directions, water in the outer drum is exchanged with water in the inner drum to form water flow, in order to drive the cleaning pellets between the inner and outer drums to move with water, collide with and rub the walls of the inner and outer drums, and also remove, with the help of soakage, attachments on the walls of the inner and outer drums and the bottom part of the inner drum, which fundamentally prevent the generation of dirt and bacteria breeding. When a user is doing laundry, the inner and outer drums are cleaned at the same time. Washing and cleaning are simultaneous without dirt remaining, and cleanliness and comfort are provided.

In certain embodiments, after washing, during water drainage, the inner drum rotates at a low speed so that the cleaning ball clamped between the walls of the inner and outer drums falls into space between the inner and outer drums, and the cleaning pellets flow with water and enter the water drainage valve through the water drainage port, and are collected in the pellet receiving chamber by the filtration structure. Even the cleaning pellets left at the bottom part of the inner drum can still be collected by controlling the inner drum during spin-drying to realize fully collection, which avoids noises caused by the cleaning pellets colliding with the drum walls during spin-drying.

These and other aspects of the present invention will become apparent from the following description of the preferred embodiment taken in conjunction with the following drawings, although variations and modifications therein may be affected without departing from the spirit and scope of the novel concepts of the invention.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
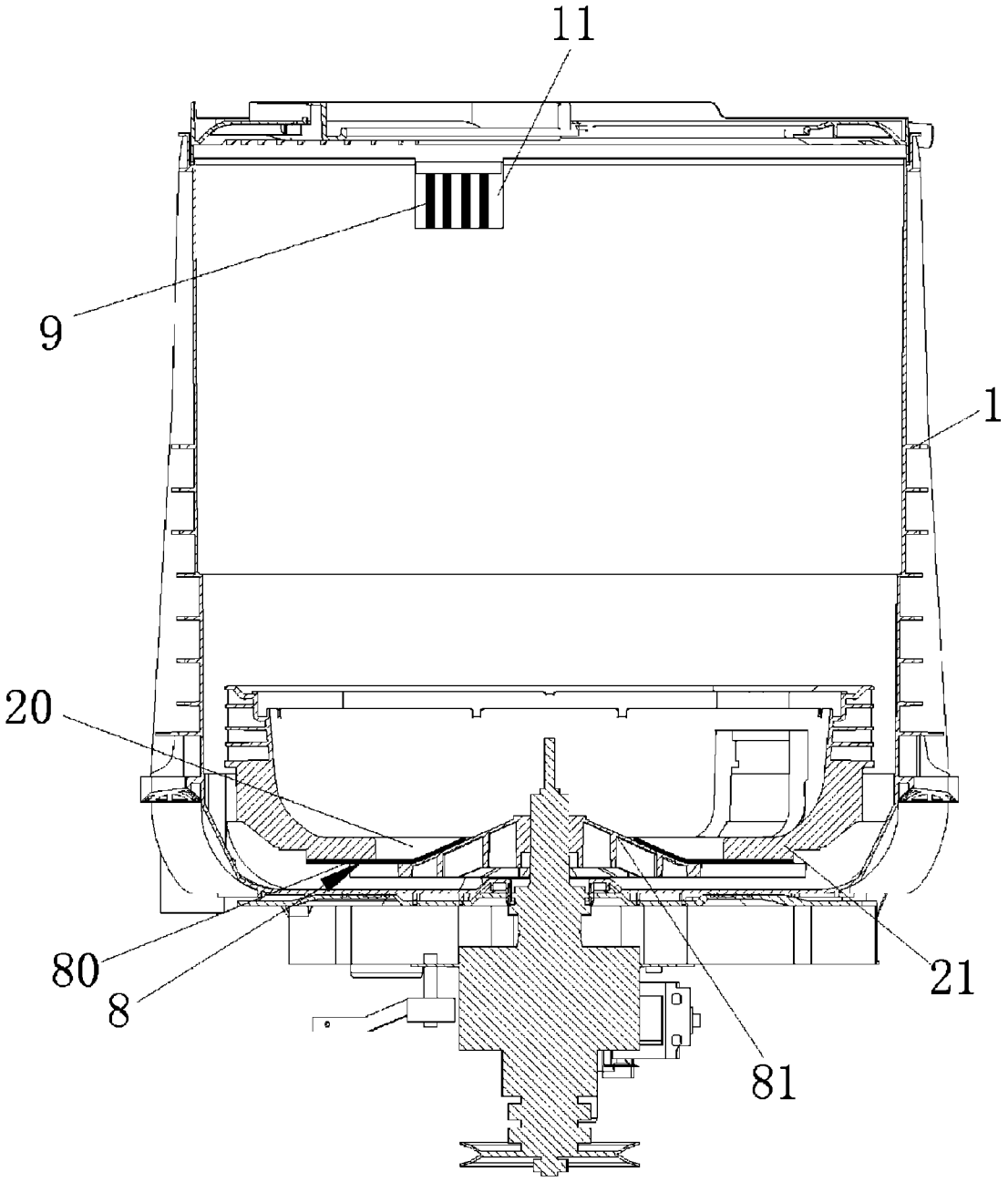
FIG. 1 is a partial cross-sectional view of the outer drum of the washing machine according to one embodiment of the present invention.

The invention will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" or "has" and/or "having" when used herein, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom", "upper" or "top," and "front" or "back" may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

The description will be made as to the embodiments of the invention in conjunction with the accompanying drawings in FIGS. 1-15. In accordance with the purposes of this invention, as embodied and broadly described herein, this invention, in certain aspects, relates to a self-cleaning washing machine in which drum walls between inner and outer drums are automatically cleaned with water flow by using cleaning pellets, and a control method thereof for collecting cleaning pellets.

Figure 2:
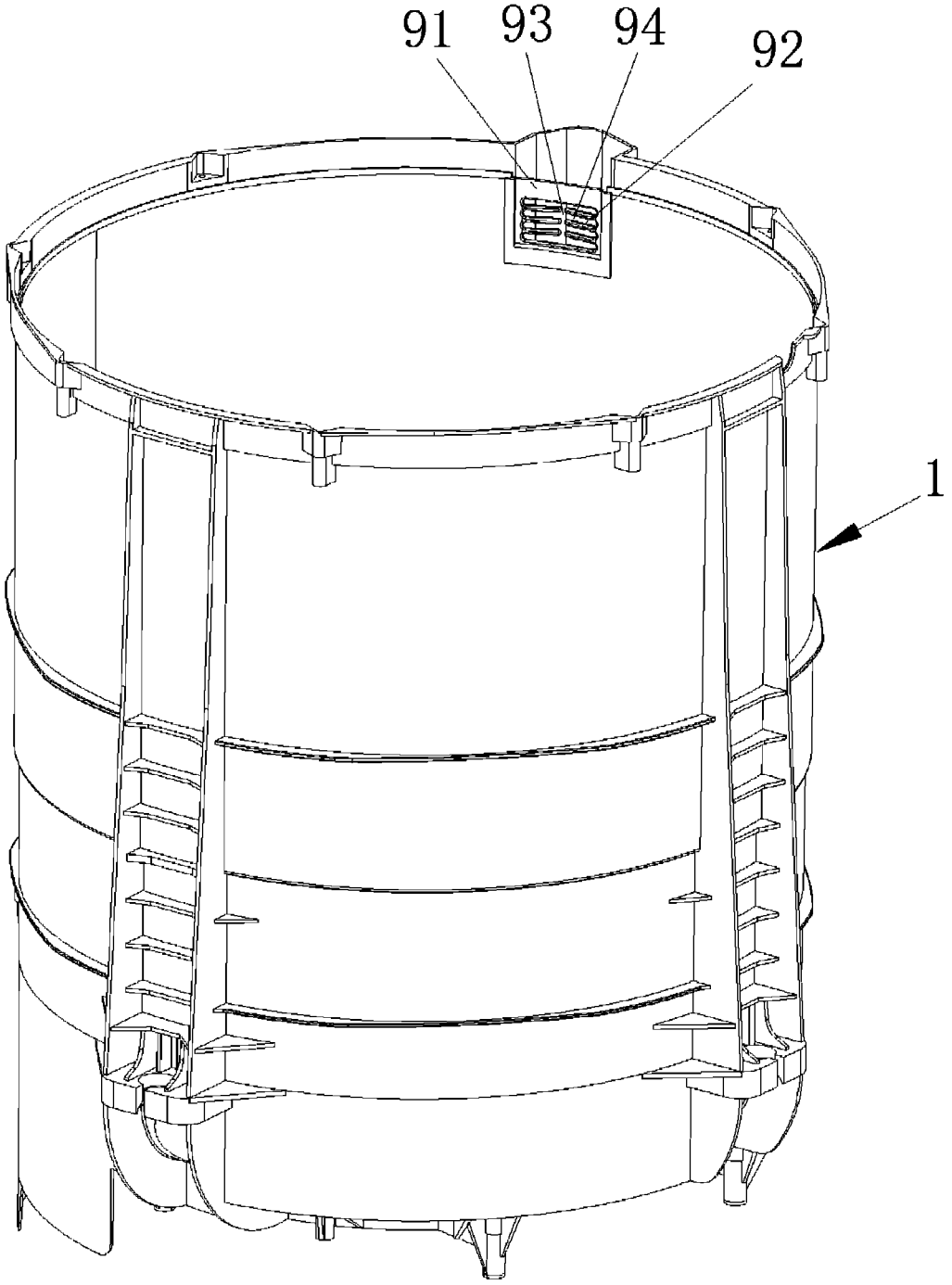
FIG. 2 is a schematic structure diagram of the outer drum according to one embodiment of the present invention.
Figure 3:
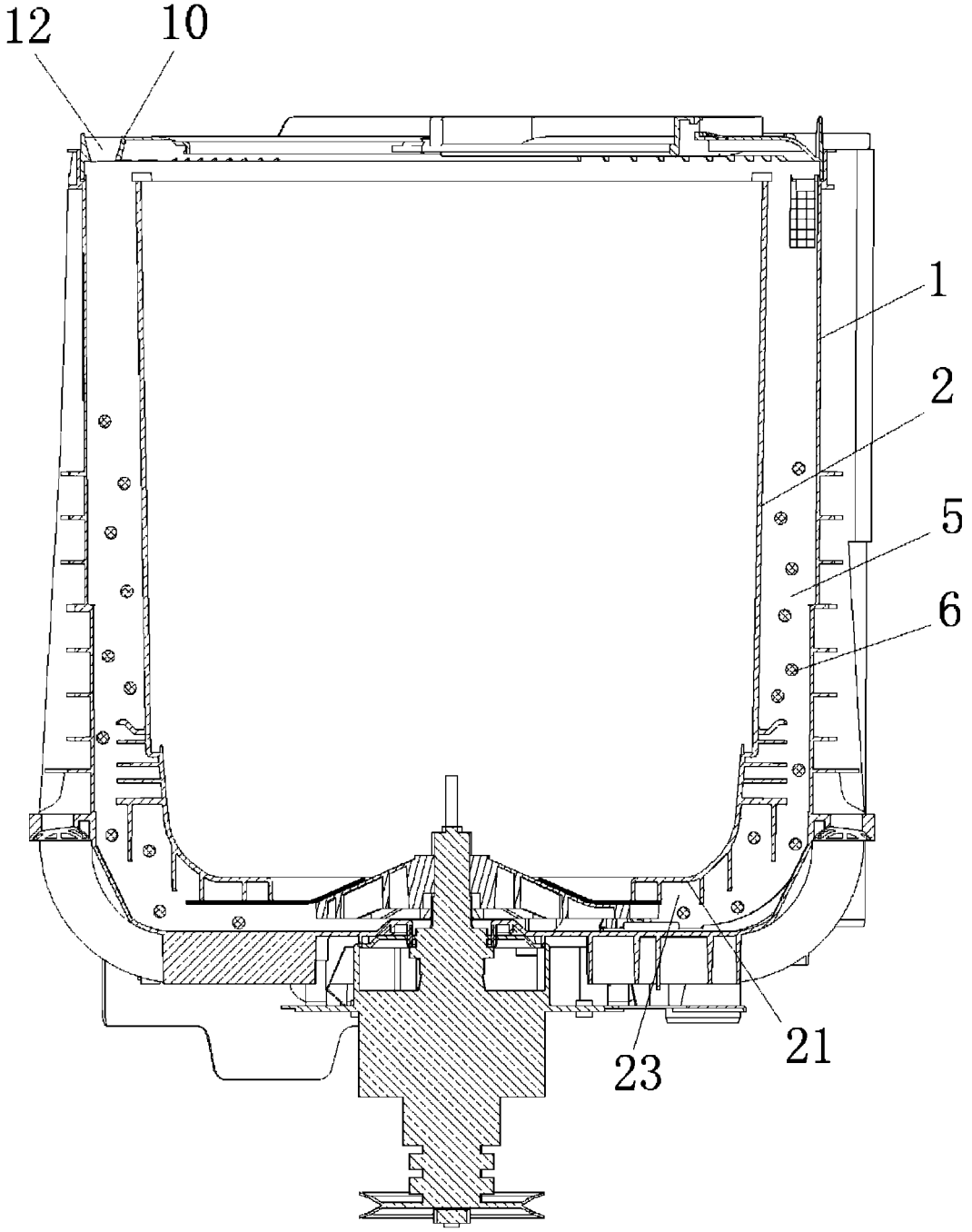
FIG. 3 is a cross-sectional view of the outer drum and inner drum of the washing machine according to one embodiment of the present invention.

As shown in FIGS. 1-11, the self-cleaning washing machine of the present invention includes an outer drum 1, an inner drum 2, a wave wheel 3, and a water drainage apparatus 4, wherein cleaning pellets 6 for cleaning an inner wall of the outer drum and an outer wall of the inner drum are provided in a chamber 5 defined between the inner drum 2 and the outer drum 1 (referring to FIG. 3). The washing machine is provided with an isolating structure to prevent the cleaning pellets from escaping from the chamber, wherein the isolating structure includes a filtration mechanism 7 arranged in the water drainage apparatus 4 to prevent the cleaning pellets from being drained away when water is drained, and/or a grid mechanism 8 arranged at the bottom part of the inner drum to prevent the cleaning pellets from entering the inner drum from the bottom of the inner drum, and/or a filtration grid 9 arranged at a water overflow port 11 of the outer drum to prevent the cleaning pellets from flowing out with overflow water.

Embodiment 1

As shown in FIG. 2, according to this embodiment, the isolating structure of the washing machine includes the filtration grid 9. The filtration grid 9 includes a frame body 91 that matches the water overflow port 11 and stopping ribs 92 arranged in the frame body. The stopping ribs 92 are divided into left and right groups. A partition gap 93 smaller than the cleaning pellets is defined between the two groups of stopping ribs 92. A gap 94 smaller than the cleaning pellets is defined between the two adjacent stopping ribs 92 in the same group. The two groups of stopping ribs 92 correspond to a filtration surface formed at an inner side of the outer drum 1, which is a cambered surface towards, at a position of the partition gap 93, the other side along the direction of a stopping rib or an inclined surface. The structure helps lint twined on the stopping rib to be flushed by the stirring water to an overflow pipe.

In certain embodiments, the left and right groups of stopping ribs are arranged symmetrically or are arranged with alternate extension directions.

In one embodiment, the filtration grid and the outer drum are of a plug-and-pull structure, where slots are arranged at two sides of the water overflow port, and the filtration grid is inserted in the slots (not shown in the figure). In another embodiment, the filtration grid and the outer drum are of a snap-on structure.

The filtration grid and the outer drum are in a separable structure according to the above embodiments. In certain embodiments, the filtration grid and the outer drum may also be integrated by injection molding. In certain embodiments, the filtration grid may also be a horizontal grid structure, or a vertical grid structure, or a screen structure.

Embodiment 2

As shown in FIG. 3, according to this embodiment, the isolating structure includes an outer drum cover 10 arranged on the top part of the outer drum 1 to cover an annular opening of the chamber 5 between the inner and outer drums, wherein corresponding to the annular opening, the outer drum cover 10 is provided with a pellet inlet 12 for supplementing cleaning pellets to the chamber. In certain embodiments, the pellet inlet is further provided with a cover that can be opened and closed.

Embodiment 3

Figure 4:
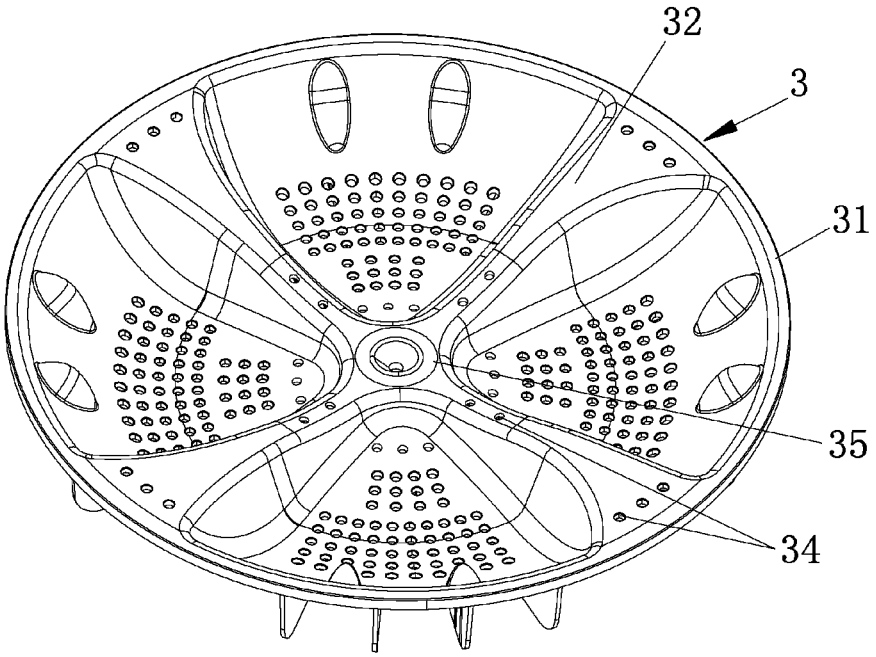
FIG. 4 is a schematic structure diagram of the wave wheel according to one embodiment of the present invention.
Figure 5:
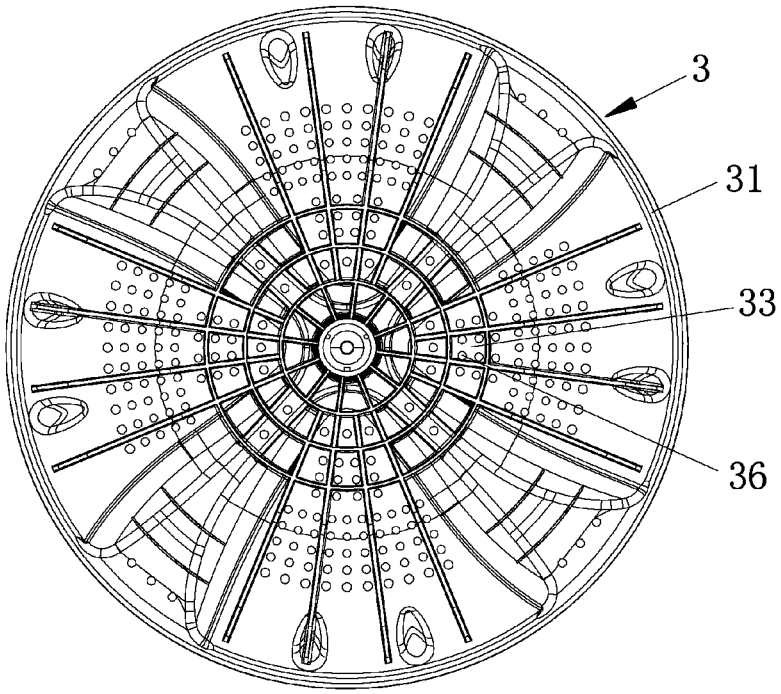
FIG. 5 is a schematic diagram of the lower surface of the wave wheel according to one embodiment of the present invention.

As shown in FIGS. 4 and 5, according to this embodiment, the wave wheel 3 is a self-cleaning wave wheel, and includes a wave plate 31 and a water stirring piece 32 arranged on the upper surface of the wave plate 31, and the top part of the water stirring piece 32 is provided with at least one water permeable hole 34, which corresponds to and communicates with a groove space of the bottom part of the water stirring piece. Multiple water permeable holes 34 are distributed on the water stirring piece 32 along the circumferential direction close to the edge of the wave plate, and at least two water permeable holes 34 are distributed on the water stirring piece along the radial direction at one end close to the center 35 of the wave wheel (referring to FIG. 4).

As shown in FIG. 5, in this embodiment, the lower surface of the wave plate 31 has multiple groove spaces 33 formed by reinforcing ribs of the wave plate, and correspond to an external area beyond the range of the water stirring piece 32. Each groove space 33 is provided with at least one water permeable hole 36 to form flushing water flow above and below the groove space. During rotation of the wave wheel, water in the groove spaces is stirred harder to clean the lower surface of the wave plate.

In certain embodiments, an antimicrobial mildew proof coat is arranged on the lower surface of the wave plate.

Embodiment 4

Figure 6:
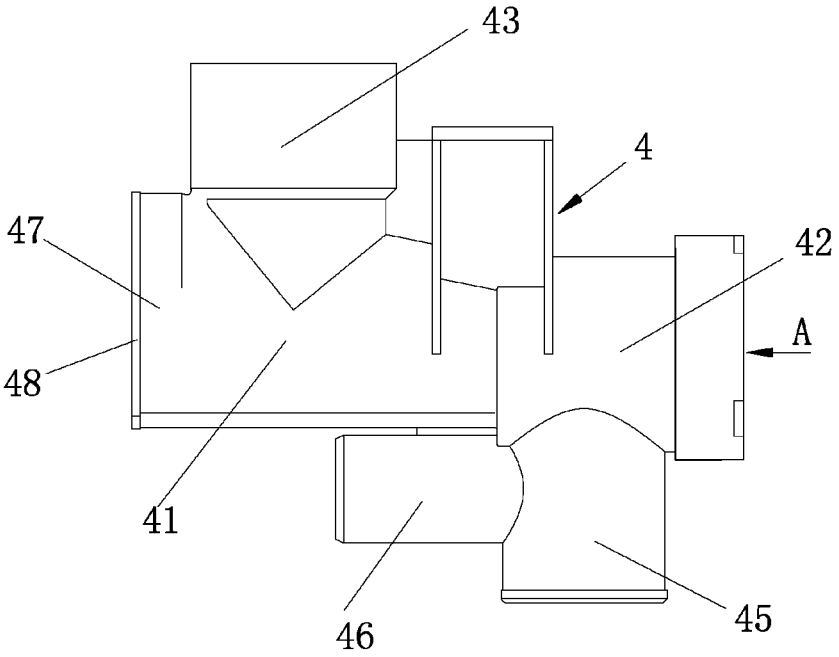
FIG. 6 is a schematic diagram of the water drainage apparatus according to one embodiment of the present invention.
Figure 7:
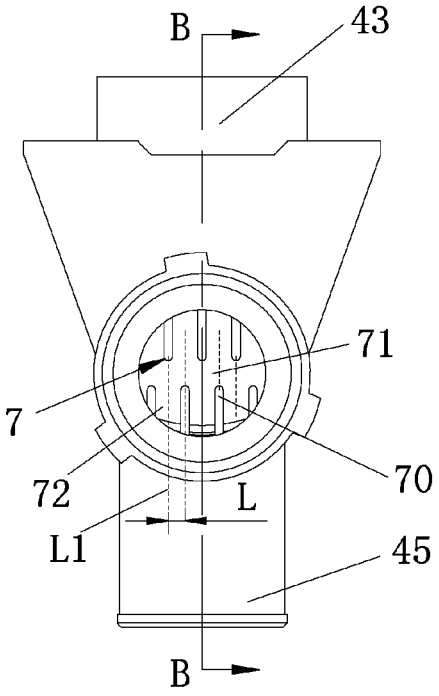
FIG. 7 is an A-direction view of the water drainage apparatus in FIG. 6.
Figure 8:
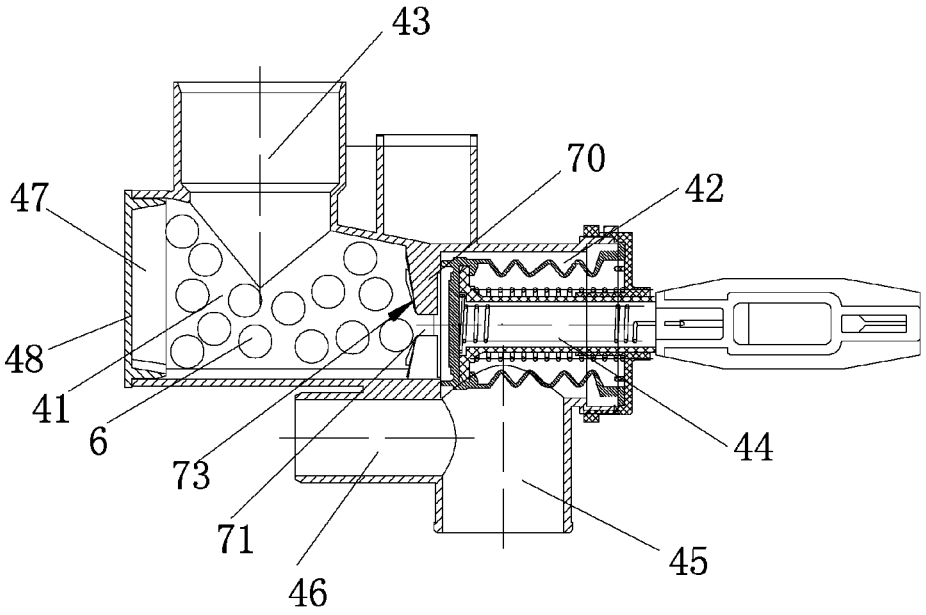
FIG. 8 is a B-B-direction sectional view of the water drainage apparatus in FIG. 7.

As shown in FIGS. 6-8, according to this embodiment, the washing machine includes the water drainage apparatus 4. In the apparatus, the cleaning pellets are collected by draining water during water drainage and dewatering to avoid noises caused by the cleaning pellets colliding with the drum walls between the inner and outer drums during dewatering. While stopping the cleaning pellets, lint, sheet-like objects such as coins and buttons, and others sundries smaller than the cleaning pellets are smoothly discharged, thereby avoiding blockage.

The water drainage apparatus 4 includes a pellet receiving chamber 41 that receives the cleaning pellets during dewatering and floats and the cleaning pellets to the chamber 5 to clean the drum walls under the buoyant force during water feeding, and a water drainage chamber 42, and the filtration mechanism 7 arranged between the pellet receiving chamber 41 and the water drainage chamber 42. The filtration mechanism 7 can stop the cleaning pellets, from which lint and sundries smaller than the cleaning pellets can be discharged.

The filtration mechanism 7 includes multiple stopping ribs 70 that stop the cleaning pellets. The stopping ribs 70 are divided into two groups. A notch 71 smaller than the cleaning pellet is defined between the two groups of stopping ribs 70, and a filtration gap 72 smaller than the cleaning pellet is defined between two adjacent stopping ribs 70 in the same group. The two groups of stopping ribs 70 correspond to a filtration surface 73 formed at one side of the pellet receiving chamber 41, which is a cambered surface towards, at a position of the notch 71, the other side or an inclined surface (referring to FIG. 8), and the filtration surface 73 is of V-shaped with the bottom part open or trapezoidal-shaped with an upper base longer than the lower base. The notch 71 enables lint twined on a stopping rib to slide to the tail end of the stopping rib and pass through the notch, through which sheet-like objects such as buttons and coins can pass, thereby further reducing the possibility of lint blockage.

In certain embodiments, as shown in FIG. 7, the notch 71 separates the stopping ribs 70 into two oppositely arranged comb structures, and extension lines L1s of stopping ribs of the two comb structures are alternate. By using the structure with alternate extension lines L1s of stopping ribs, under the condition that the cleaning pellets are fixed in size, even though the distance between the two adjacent stopping ribs is increased, cleaning pellets can still be stopped, thereby further reducing the possibility of lint blockage.

The two comb structures are arranged oppositely in an up-to-down or a left-to-right manner, a horizontal or vertical notch is placed therebetween, extension lines L1s of stopping ribs of one comb structure are vertically alternated with those of stopping ribs of the other comb structure, straight lines on which the stopping ribs of the two comb structures are located are parallel, and the same spacing L is placed between each two adjacent straight lines. End parts of three stopping ribs, adjacent to each other, of the two comb structures form a pellet stopping part of the notch in the triangular area. Tests have found out that compared with the comb structure with upper stopping ribs and lower stopping ribs symmetrically arranged, under the condition that the cleaning pellets and the notch are all fixed in size, a distance between the two adjacent stopping ribs of each comb structure can be larger while the cleaning pellets can still be stopped.

The water drainage apparatus 4, according to certain embodiments, is arranged below the outer drum 1. A through port 43 that communicates with a water drainage port at the bottom of the outer drum is arranged on an upper wall of the pellet receiving chamber 41, and the upper wall of the pellet receiving chamber 41 inclines upward from the periphery to the through port 43. The inclining direction enables the cleaning pellets to rise with the water level and flow to the through port, and further enter the chamber 5 between the inner and outer drums through the water drainage port. During the water drainage and dewatering processes, the cleaning pellets enter the pellet receiving chamber with draining water flow. When water is fed again, the cleaning pellets float upward with rise of the water level of the pellet receiving chamber, and the cleaning pellets move along the inclining direction, that is, move upward in an inclining manner, to enter the through port more conveniently, and then enter the space between the inner and outer drums through the water drainage port.

As shown in FIG. 8, according to this embodiment, the through port 43, the pellet receiving chamber 41, and the water drainage chamber 42 communicate sequentially to form an L-shaped water outlet channel. A water drainage valve 44 is mounted in the water drainage chamber 42. A water outlet 45 connected with a water drainage pipe of the washing machine is arranged on a lower end of the water drainage chamber 42, and the water outlet 45 is provided with an overflow pipe connection port 46 that communicates with the water outlet. An opening 47 communicating with outside is at one side of the pellet receiving chamber 41 opposite to the water drainage chamber 42. The opening 47 is provided with a sealing cover 48 that can be opened and closed, and a circumferential inner wall of the sealing cover 48 is in a conical frustum circumferential wall structure with an aperture gradually enlarged toward inside of the pellet receiving chamber.

According to this embodiment, when water is fed to the washing machine the next time, the cleaning pellets can be put in between the inner and outer drums again under the buoyant force of the fed water to continue to clean the drum walls, and the used inclined inner wall structure makes it easier to use the cleaning pellets again, which avoids blockage caused by failure of the cleaning pellets in floating upward. The structure is simple, and the manufacturing and mounting costs are low.

Embodiment 5

Figure 9:
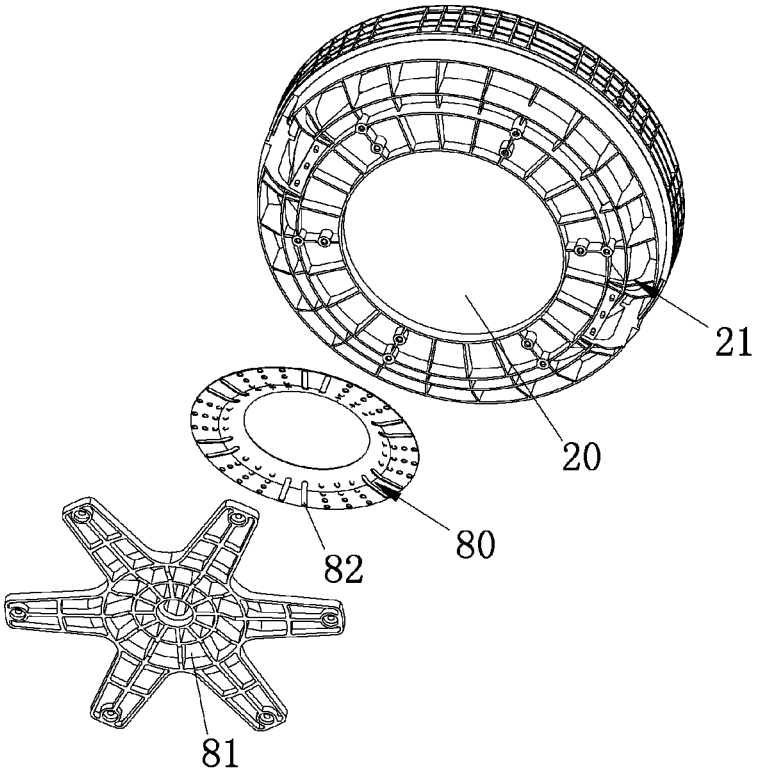
FIG. 9 is a schematic diagram of the mounting structure of the bottom of the inner drum, the stop cover and the flange plate according to one embodiment of the present invention.

As shown in FIG. 9, in one embodiment, a flange plate 81 is mounted on the bottom part 21 of the inner drum of the washing machine, where the flange plate 81 forms a water permeable channel with a hollow area 20 of the bottom part of the inner drum. According to this embodiment, the grid mechanism 8 prevents the cleaning pellets from entering the inner drum from the water permeable channel of the bottom part of the inner drum, where the grid mechanism includes a stop cover 80 that matches the flange plate 81 to prevent the cleaning pellets from entering the inner drum from the hollow area 20 of the bottom of the inner drum, and the top cover 80 is provided with water through holes 82 capable of stopping the cleaning pellets. In certain embodiments, the water through holes 82 is arranged corresponding to the water permeable channel.

The water through holes 82 are a straight elongated slit structure or a bent elongated slit structure. Because most lint in washing water is collected by a lint filtration structure, and only a little lint exists and is distributed as thin strips, the water through hole does not cause lint blockage. Further, the water through holes 82 are in a funnel structure with a size shrinking from up to down. Foreign bodies such as coins and buttons can pass through the structure, thereby reducing the possibility of blockage while preventing the cleaning pellets from entering the inner drum therefrom.

The stop cover includes a donut-like annular cover body defining a hollow region therein. The main body of the flange plate correspondingly blocks the hollow region of the stop cover, the diameter of the main body of the flange plate being d, the diameter of the hollow area of the bottom part of the inner drum being D, the inner diameter of the stop cover being d1, and the outer diameter of the stop cover being d2.

According to this embodiment, the stop cover 80 has an independent structure, clamped or adhered between the bottom 21 of the inner drum and the flange plate 81, or the stop cover 80 and the bottom of the inner drum are integrated, or the stop cover 80 and the flange plate 81 are integrated, or the stop cover 80, the bottom of the inner drum, and the flange plate are integrated. The stop cover can prevent the cleaning pellets between the inner and outer drums from entering the inner drum, which can prevent quantity reduction of the cleaning pellets between the inner and outer drums to affect the drum wall cleaning.

When the stop cover 80 and the bottom part 21 of the inner drum are integrated by injection molding, $d1 \leq d < D = d2$ is satisfied, that is, the water through holes 82 are arranged in an area of the stop cover 80 that is beyond the central area of diameter d and corresponding to an area between two adjacent fixing feet 85 of the flange plate 81.

When the stop cover 80 has an independent cover body structure, the outer diameter d2 of the stop cover is the same as the diameter D of the hollow area of the bottom part of the inner drum, and the stop cover 80 is embedded and adhered in the hollow area 20 of the bottom part of the inner drum. In this case, $d1 \leq d$, that is, the stop cover 80 has a partial annular cover body overlapping the main body 84 of the flange plate, and the water through holes 82 are distributed in an external area of an annular cover body that does not overlap the main body 84 of the flange plate, corresponding to an area between adjacent fixing feet 85 of the flange plate 81. In certain embodiments, a snap-fit structure is arranged at an outer side of the stop cover and embedded on a corresponding snap-on structure at an outer side of the hollow area of the bottom part of the inner drum, for example, a slot is arranged on the edge of the stop cover, and a jaw matching the slot is correspondingly arranged at a lateral side of the hollow area of the bottom part of the inner drum.

When the stop cover 80 has an independent cover body structure, the outer diameter d2 of the stop cover is greater than the diameter D of the hollow area 20 of the bottom part of the inner drum, the stop cover is clamped between the flange plate 81 and the bottom part 21 of the inner drum by using a fixing foot 85 of the flange plate, and $d1 \leq d < D < d2$ is satisfied. The inner diameter d1 of the stop cover 80 may be equal to the diameter d of the main body 84 of the flange plate, the water through holes 82 are arranged in an area, of the stop cover 80, corresponding to the area between two adjacent fixing feet 85 of the flange plate 81. In certain embodiments, the stop cover is mounted on the bottom of the inner drum and then is clamped between the flange plate and the bottom of the inner drum by using the flange plate.

When the outer diameter d2 of the stop cover 80 is less than the inner diameter D of the hollow area 20 of the bottom part of the inner drum, $d1 \leq d < d2 < D$ is satisfied, and the difference between the inner diameter D of the hollow area 20 of the bottom part of the inner drum and the outer diameter d2 of the stop cover 80 satisfies that the cleaning pellets are incapable of passing through a gap between the edge of the hollow area of the bottom part of the inner drum and the periphery of the stop cover. The stop cover is arranged in the hollow area 20 of the bottom of the inner drum, and may be connected with the bottom part of the inner drum by using a plurality of connection ribs distributed on the edge, or be integrated with the bottom part of the inner drum by injection molding using the connection ribs (not shown in the figure), or be connected with the bottom part of the inner drum by using a snap-fit structure extending at the edge of the stop cover, or the stop cover is mounted on the flange plate, the stop cover corresponding to a position of the hollow area, and the flange plate fixed with the bottom part of the inner drum.

Embodiment 6

Figure 10:
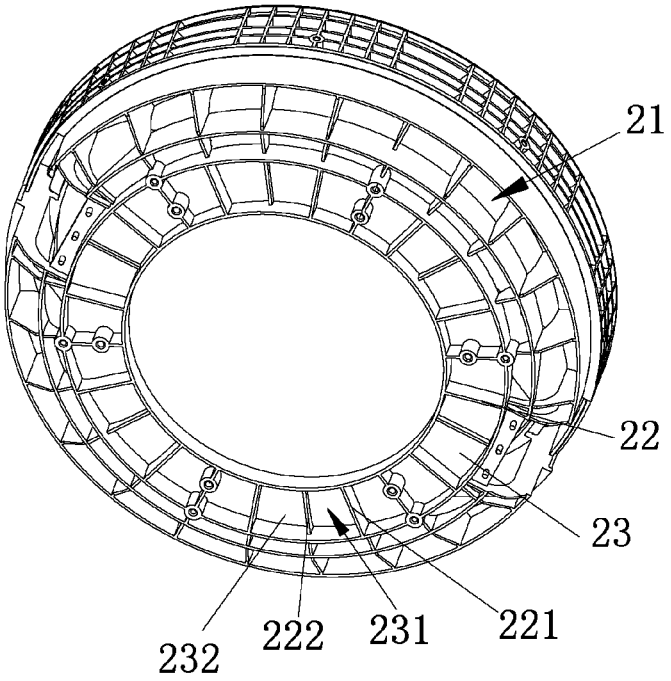
FIG. 10 and FIG. 11 are schematic structure diagrams of different implementation manners of the inner drum of the washing machine according to certain embodiments of the present invention respectively.
Figure 11:
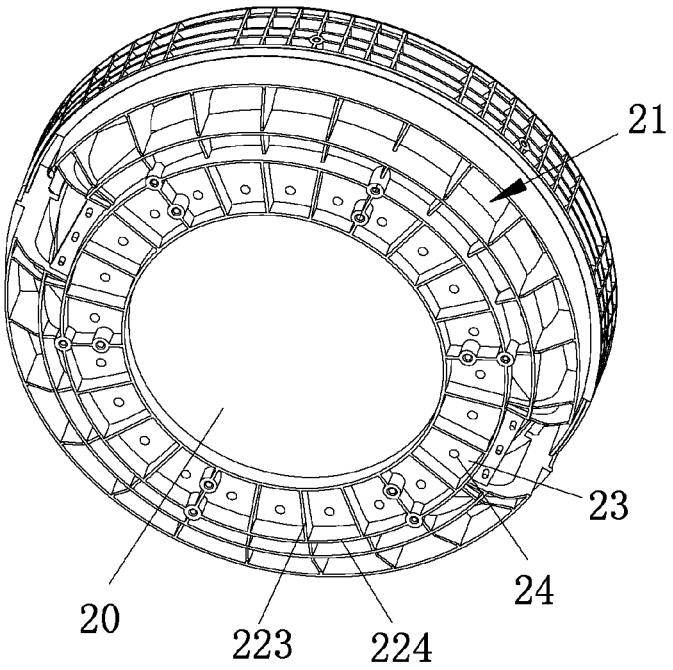

As shown in FIGS. 10 and 11, in this embodiment, multiple grooves 23 formed by reinforcing ribs 22 at the bottom 21 of the inner drum in a surrounding manner are provided outside the drum bottom, the gap between the bottom part of the reinforcing rib and the bottom of the outer drum is larger than the cleaning pellet, and the grooves 23 formed by reinforcing ribs 22 at the drum bottom in a surrounding manner is capable of receiving at least 2 cleaning pellets and generally capable of receiving 3 to 5 cleaning pellets. Each groove is accessible to the cleaning pellets, so that the cleaning pellets move with water flow to obtain acceleration to collide with and rub the drum walls between the inner and outer drums.

The grooves 23 include large grooves 231 formed by reinforcing ribs 221 outside the drum bottom in a surrounding manner and small grooves 232 formed by division of reinforcing ribs 222 inside the drum bottom (referring to FIG. 10), the reinforcing ribs 221 outside the drum bottom are higher than the reinforcing ribs 222 inside the drum bottom, and the reinforcing ribs inside the drum bottom are not higher than about 5 mm. In certain embodiments, corresponding to each groove, at least one water permeable through hole 24 is added to the bottom 21 of the inner drum (referring to FIG. 11), which not only reduces dirt adhered on the walls between the inner and outer drums, but also improves the mobility of the cleaning pellets, thereby preventing the cleaning pellets from being clamped at the bottom of the inner drum.

As shown in FIG. 11, the grooves 23 are formed by multiple radial reinforcing ribs 223 and multiple circumferential reinforcing ribs 224, and distributed on the lower end of the annular bottom 21 of the inner drum. Because the bottom 21 of the inner drum is circular, the spacing between two adjacent radial reinforcing ribs 223 gradually shrinks along the direction to the center. To ensure that the cleaning pellets have enough large space to move, it is required that the angle between each two of adjacent radial reinforcing ribs 223 forming the grooves 23 should be about 12° to about 30°, and the spacing between two circumferential reinforcing ribs 224 that are adjacent along the radial direction should be about ⅙ to about ½ of the radius of the bottom of the inner drum. In certain embodiments, the spacing between the two circumferential reinforcing ribs 224 close to the hollow area 20 of the bottom of the inner drum is the largest.

In this embodiment according to the present invention, the cleaning pellets can float in the water, flowing between the inner and outer drums of the washing machine with water flow to impact the walls of the inner and outer drums. During the washing process, water flow drives the cleaning pellets to collide with and rub the walls of the inner and outer drums to clean the drum walls between the inner and outer drums of the washing machine, and after washing, water is drained from the water drainage apparatus, and the cleaning pellets flow to the pellet receiving chamber with the drained water and are collected in the pellet receiving chamber. When water is fed for rinsing or washing in the next time with the rise of the water level of the fed water, the cleaning pellets flow out of the pellet receiving chamber from the water drainage port and flow into the outer drum.

Putting cleaning pellets between inner and outer drums to clean walls of the inner and outer drums is learned from the fact that washed objects in the inner drum rub the inner drum so that the inner drum has no dirt adhered thereon and no bacteria breed thereon. The cleaning pellets may be sponge typed objects, and may also be rubber or plastic foamed objects, such as foamed rubber, foamed plastic, and foamed composite polyurethane. In certain embodiments, an absorptive material is used so that better drum wall cleaning effect is achieved. The cleaning pellets should have certain elasticity, a smaller density than that of water when dry, soakage in water and cheap. After multiple uses, cleaning pellets can be taken out by opening a sealing cover of an opening of a storage chamber and recycled, and then new cleaning pellets are used. The cleaning pellets are ball-shaped, block-shaped, ellipsoid-shaped, cylinder-shaped, or regular tetrahedron-shaped, or are other irregular mass-like pellets, with a quantity of about 3 to about 50. These pellets have a density smaller than that of water, and have certain elasticity and abrasive resistance.

Embodiment 7

Figure 12:
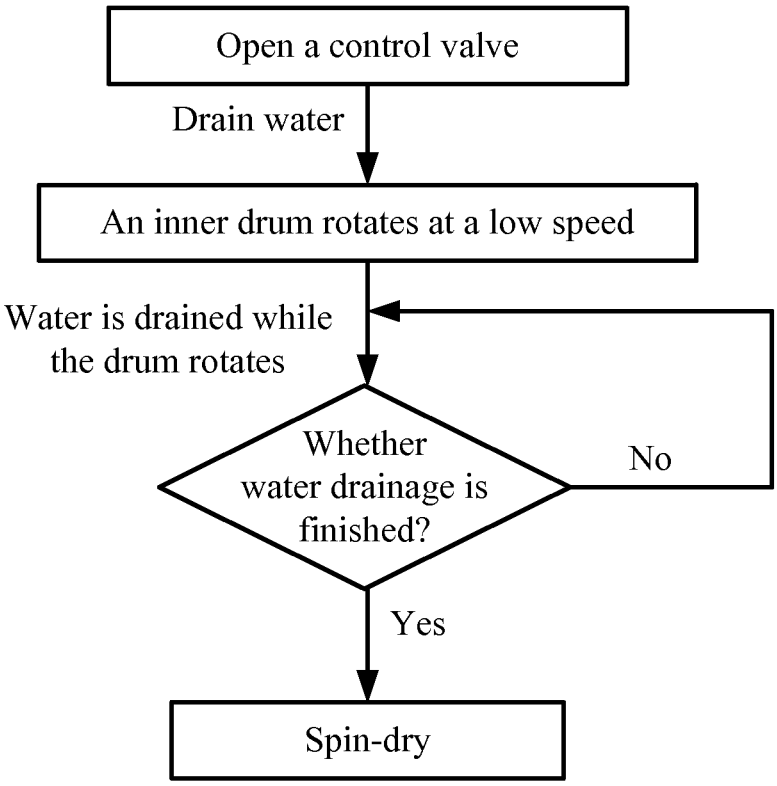
FIGS. 12-15 are schematic flowcharts of the control method for collecting pellets according to certain different embodiments of the present invention.

As shown in FIG. 12, in this embodiment, during the process of draining water, the inner drum is controlled to rotate to enable the cleaning pellets clamped between the walls of the inner and outer drums to fall off, flow with draining water and collected in the water drainage valve. In certain embodiments, after washing and during water drainage, the inner drum is controlled to rotate at a low speed of about 5 to about 50 rpm, generally about 10 to about 30 rpm, so that the cleaning ball clamped between the walls of the inner and outer drums falls into the space between the inner and outer drums, and the cleaning pellet 6 flows through the water drainage port with water flow and enters the water drainage apparatus 4, and is filtered by the filtration mechanism 7 and collected in the pellet receiving chamber 41 (referring to FIG. 8).

Embodiment 8

Figure 13:
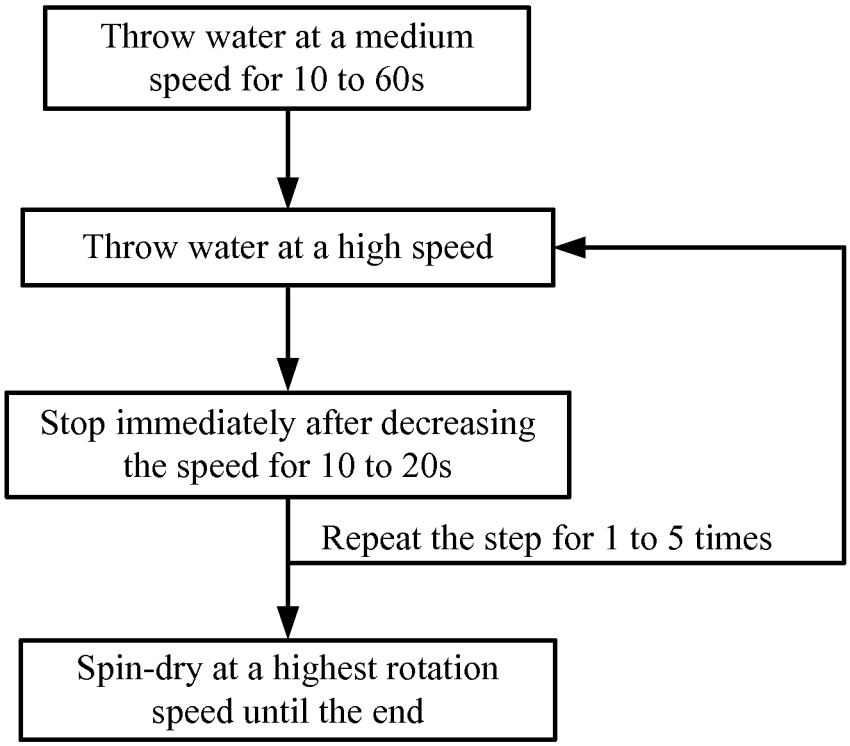

As shown in FIG. 13, in this embodiment, during the spin-dry stage, spin-drying is carried out at a medium speed, pellets left at the bottom part of the outer drum are flushed to the water drainage valve by using water thrown from the laundry, and then the inner drum is controlled to rotate at a high speed and stop to shake off the cleaning pellets clamped between the walls of the inner and outer drums, and collect the cleaning pellets in the water drainage valve. Specific steps are as follows:

(a) after water drainage, the inner drum spins the laundry at a medium speed for about 10 to about 60 seconds to throw most water out of the laundry and to flush the cleaning pellets left at the bottom part of the outer drum to the water drainage valve;

(b) the inner drum stops in about 10 to about 20 seconds after accelerating to a high speed to shake off pellets clamped between the walls of the inner and inner drums;

(c) step (b) is repeated for about 1 to about 6 times, preferably about 2 to about 3 times; and (d) spin-drying is carried out at a highest rotational speed until the end.

Embodiment 9

The difference between this embodiment and Embodiment 8 is that: the inner drum is controlled to repeat actions for about 2 to about 8 times with a rule of rotating at a medium speed for about 2 to about 5 seconds and stopping for about 5 to about 15 seconds, preferably about 4 to about 6 times, to replace the action of continuously spinning the laundry at a medium speed for about 10 to about 60 seconds by the inner drum in step (a) of Embodiment 8.

Embodiment 10

Figure 14:
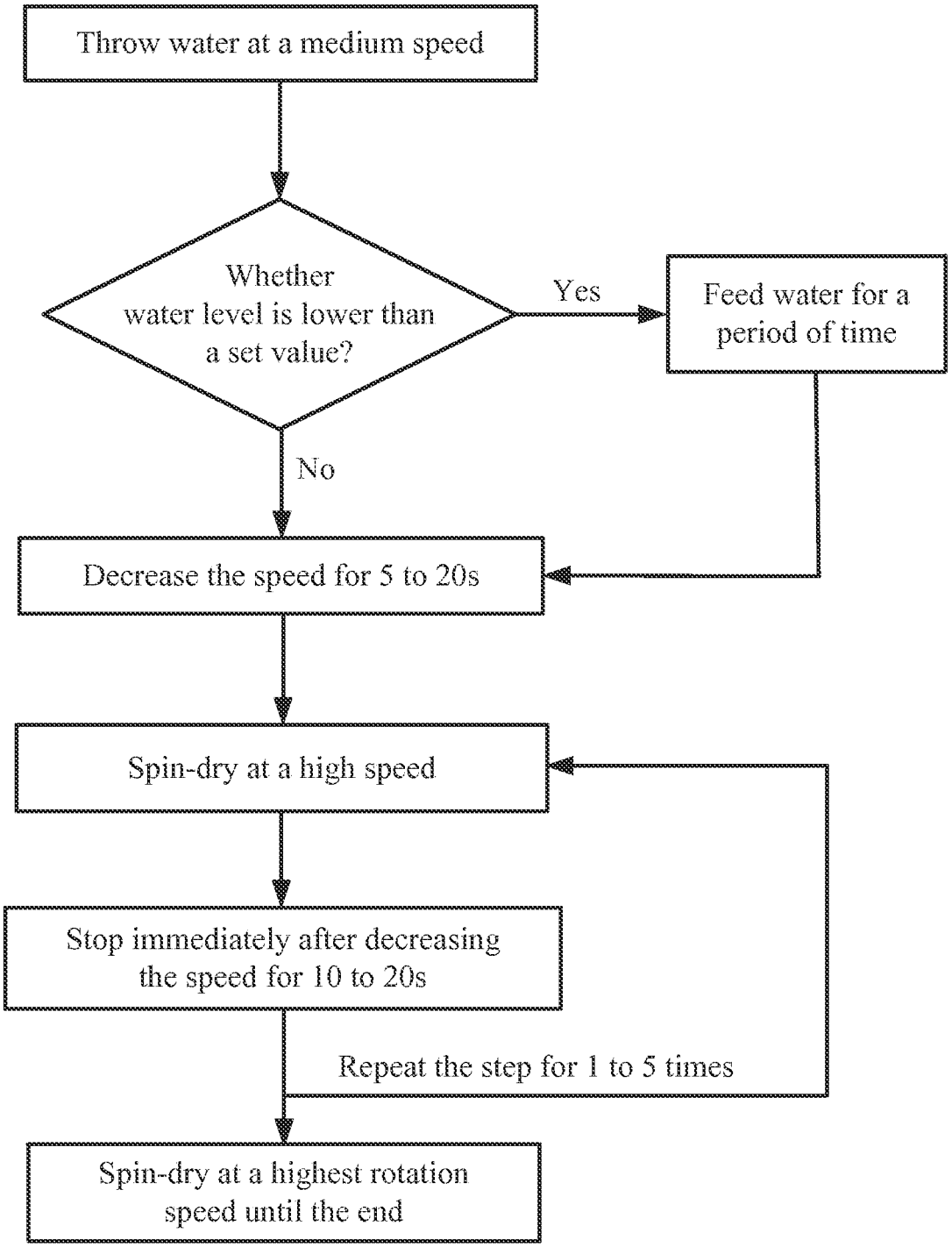

The difference between this embodiment and Embodiment 8 or Embodiment 9 is that: between step (a) and step (b), a step of feeding water for flushing is added. Specifically, as shown in FIG. 14, after water drainage and after spin-drying is carried out at a medium speed for a set time, water feeding is carried out for about 5 to about 15 s while spin-drying is continued, to increase flushing water flow and assist the cleaning pellets to flow through the water drainage port and enter the water drainage valve.

Embodiment 11

In this embodiment, the following step is added based on Embodiment 8 or Embodiment 9: if the amount of washed laundry is lower than a set value, step (c) is replaced by feeding water for about 5 to about 15 seconds, repeat step (a), and then repeat step (b).

Embodiment 12

Figure 15:
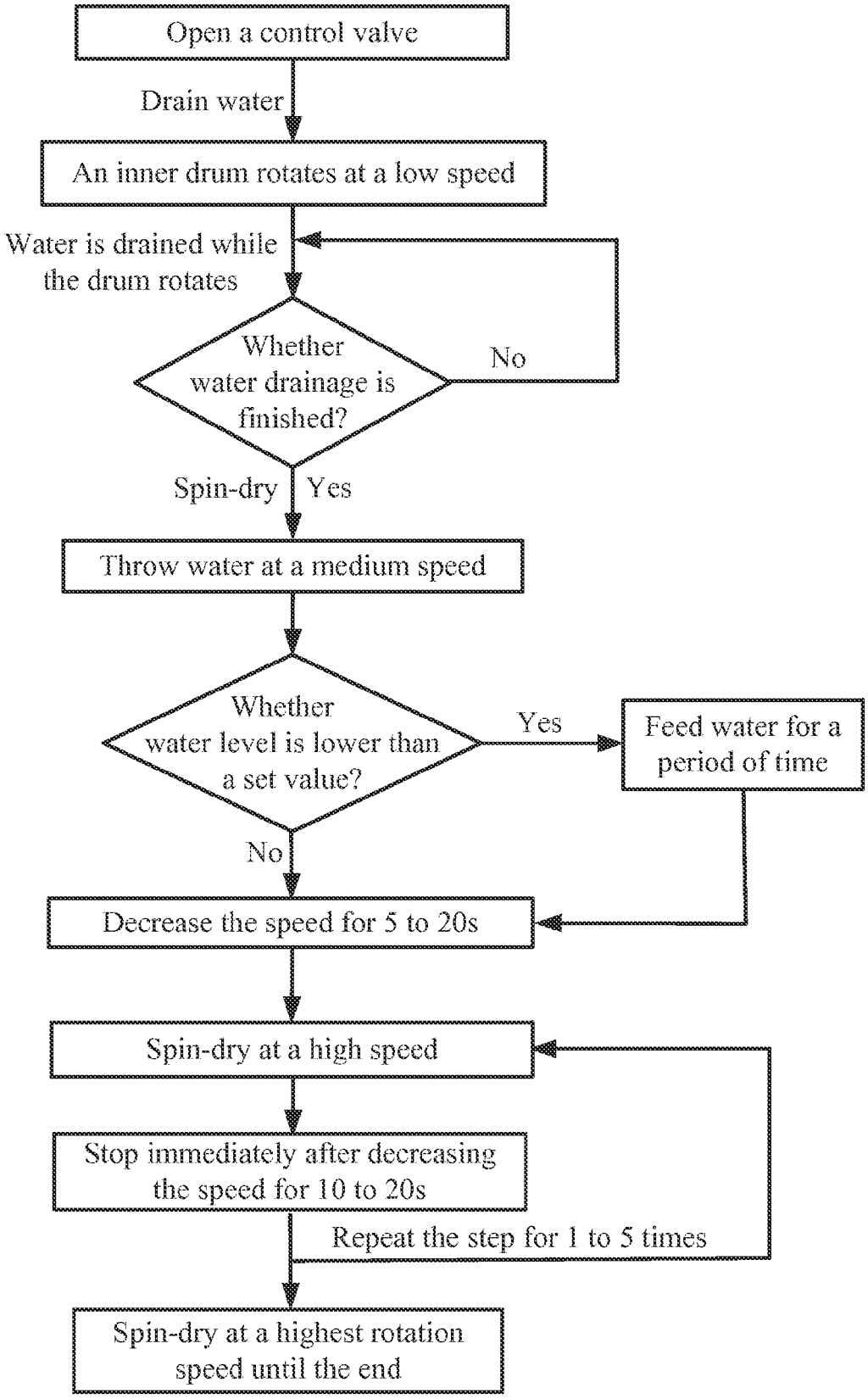

As shown in FIG. 15, in this embodiment, firstly in the process of draining water, the inner drum is controlled to rotate to shake off cleaning pellets clamped between the walls of the inner and outer drums, and the cleaning pellets flow with drained water and are collected in the water drainage valve (referring to Embodiment 7); and then during the spin-dry stage, the inner drum is controlled to rotate at medium and high speeds to collect cleaning pellets clamped between the walls of the inner and outer drums to the water drainage valve (referring to Embodiment 8 to Embodiment 11).

In the foregoing Embodiments 8-12, during the spin-dry stage, the medium rotational speed is in a range of about 200 to about 500 rpm, the high speed is in a range of about 500 to about 700 rpm, and the highest rotational speed is in a range of about 700 to about 1600 rpm; and time allocation for each action during the stage is determined according to total time of the spin-dry procedure.

The foregoing description of the exemplary embodiments of the invention has been presented only for the purposes of illustration and description and is not intended to be exhaustive or to limit the invention to the precise forms disclosed. Many modifications and variations are possible in light of the above teaching. Although not explicitly described in the present invention, other embodiments within the scope of the invention and defined by the claims may be obtained by combining, modifying or changing the exemplary embodiments as described in the present invention.

The exemplary embodiments were chosen and described in order to explain the principles of the invention and their practical application so as to activate others skilled in the art to utilize the invention and various exemplary embodiments and with various modifications as are suited to the particular use contemplated. Alternative embodiments will become apparent to those skilled in the art to which the invention pertains without departing from its spirit and scope. Accordingly, the scope of the invention is defined by the appended claims rather than the foregoing description and the exemplary embodiments described therein.

What is claimed is:

1. A self-cleaning washing machine, comprising:

an outer drum;

an inner drum;

a wave wheel;

a water drainage apparatus arranged under the outer drum;

cleaning pellets provided in a chamber defined between the inner drum and the outer drum for cleaning an inner wall of the outer drum and an outer wall of the inner drum; and an isolating structure for preventing the cleaning pellets from escaping from the chamber, wherein the isolating structure comprises at least one of a filtration mechanism arranged in the water drainage apparatus to prevent the cleaning pellets from being flushed away when water is drained, and a grid mechanism arranged at the bottom part of the inner drum to prevent the cleaning pellets from entering the inner drum from the bottom of the inner drum, wherein the water drainage apparatus comprises a water drainage chamber, a pellet receiving chamber for receiving the cleaning pellets during dewatering and floating, under the buoyant force during water feeding, the cleaning pellets to the chamber to clean the drum walls, and a through port, being in communication with a water drainage port at the bottom of the outer drum, formed on an upper wall of the pellet receiving chamber, wherein the upper wall of the pellet receiving chamber inclines upward from its periphery to the through port so as to enable the cleaning pellets to float with a water level in the pellet receiving chamber, flow to the through port, and enter the chamber between the inner and outer drums through the water drainage port;

wherein the filtration mechanism comprises multiple stopping ribs formed between the pellet receiving chamber and the water drainage chamber, wherein the stopping ribs are divided into two groups by a notch having a width smaller than the cleaning pellets, extension lines of the two groups of stopping ribs are alternate, a filtration gap smaller than the cleaning pellets is defined between the two adjacent stopping ribs in the same group, and one side of the two groups of the stopping ribs corresponding to the pellet receiving chamber forms a filtration surface that is a cambered surface towards the notch so that the filtration surface is of V-shaped with a bottom at the notch, such that the filtration mechanism enables to prevent the cleaning pellets from being discharged from the pellet receiving chamber, and enables lint twined on the stopping ribs to slide to tail ends of the stopping ribs and pass through the notch to the water drainage chamber, and enables sundries including sheet-like objects to pass through one of the filtration gap and the notch to the water drainage chamber.

2. The self-cleaning washing machine according to claim 1, wherein the two groups of stopping ribs are arranged oppositely in an up-down manner or a left-right manner, such that the notch is a horizontal notch or a vertical notch, and the extension lines of one group of stopping ribs are vertically alternate with those of the other group of stopping ribs, wherein the stopping ribs are parallel to each other, and the filtration gap between each two adjacent stopping ribs is the same.

3. The self-cleaning washing machine according to claim 1, wherein the grid mechanism comprises a stop cover that matches a flange plate for preventing the cleaning pellets from entering the inner drum from a hollow area defined in the bottom of the inner drum, and the stop cover is provided with water through holes capable of stopping the cleaning pellets.

4. The self-cleaning washing machine according to claim 3, wherein the stop cover comprises a donut-like annular cover body defining a hollow region therein, the main body of the flange plate correspondingly blocks the hollow region of the stop cover, the diameter of the main body of the flange plate being d, the diameter of the hollow area of the bottom of the inner drum being D, the inner diameter of the stop cover being d1, the outer diameter of the stop cover being d2, satisfying $d1 \leq d < D < d2$, or $d1 \leq d < d2 < D$, and wherein the difference between the diameter D of the hollow area of the bottom of the inner drum and the outer diameter d2 of the stop cover satisfying that the cleaning pellets are incapable of passing through a gap defined between the edge of the hollow area of the bottom of the inner drum and the periphery of the stop cover.

5. The self-cleaning washing machine according to claim 3, wherein the stop cover is an independent structure clamped or adhered between the bottom of the inner drum and the flange plate, or is integrated with the bottom of the inner drum, or is integrated with the flange plate, or is integrated with the bottom of the inner drum and the flange plate.

6. The self-cleaning washing machine according to claim 1, wherein the bottom of the inner drum is externally provided with a pellet motion space so that when the cleaning pellets enter the pellet motion space, they move with water flow to obtain acceleration to collide with, rub and clean walls between the bottoms of the inner and outer drums, the pellet motion space being multiple grooves formed by reinforcing ribs outside the bottom of the inner drum, a space defined between the reinforcing ribs and the bottom of the outer drum satisfying that when the cleaning pellets enter the pellet motion space with water flow, a groove of the multiple grooves is capable of receiving at least two cleaning pellets.

7. The self-cleaning washing machine according to claim 1, wherein the isolating structure further comprises a filtration grid arranged at a water overflow port of the outer drum at a top of the self-cleaning washing machine to prevent the cleaning pellets from flowing out with overflow water, and wherein the filtration grid and the outer drum are integrated by injection molding, or wherein the filtration grid and the outer drum are of a separable plug-and-pull structure, wherein slots are arranged at two sides of the water overflow port, and the filtration grid is inserted in the slots, or wherein the filtration grid and the outer drum are of a snap-on structure.

8. The self-cleaning washing machine according to claim 7, wherein the filtration grid comprises a frame body that matches the water overflow port and stopping ribs arranged in the frame body, the stopping ribs being divided into two groups, wherein a partition gap smaller than the cleaning pellet is defined between the two groups of stopping ribs, a gap smaller than the cleaning pellet is defined between the two adjacent stopping ribs in the same group, and the two groups of stopping ribs correspond to a filtration surface formed at an inner side of the outer drum, which is a cambered surface towards, at a position of the partition gap, the other side along the direction of the stopping rib or an inclined surface.

9. The self-cleaning washing machine according to claim 1, wherein the isolating structure further comprises an outer drum cover arranged at the top part of the outer drum to cover an annular opening of the chamber, and corresponding to the annular opening, the outer drum cover is provided with a pellet inlet for supplementing cleaning pellets to the chamber, and wherein the pellet inlet is provided with a cover that can be opened or closed.

10. The self-cleaning washing machine according to claim 1, wherein the wave wheel is a self-cleaning wave wheel, and comprises a wave plate and a water stirring piece arranged on an upper surface of the wave plate, and the top part of the water stirring piece is provided with at least one water permeable hole, which corresponds to and communicates with the bottom part of the water stirring piece, and wherein multiple water permeable holes are distributed on the water stirring piece along a circumferential direction at a position close to the edge of the wave plate, and at least two water permeable holes are distributed on the water stirring piece along a radial direction at one end close to the center of the wave wheel.

11. The self-cleaning washing machine according to claim 10, wherein a lower surface of the wave plate has multiple groove spaces formed by reinforcing ribs of the wave plate, and corresponding to an external area beyond the range of the water stirring piece, each groove space is provided with at least one water permeable hole to form flushing water flow above and below the groove space.

12. The self-cleaning washing machine according to claim 6, wherein the volume of the grooves is enlarged by reducing the number of the reinforcing ribs, or the height of the reinforcing rib between the two reinforcing ribs is shortened so that the reinforcing rib with the shortened height does not affect motion of the cleaning pellets.

13. A control method of the self-cleaning washing machine according to claim 1, wherein during operation of the washing machine, cleaning pellets move with water flow to clean drum walls between inner and outer drums, wherein in at least one of a process of draining water and a spin-dry process, the inner drum is controlled to carry out different actions, so that the cleaning pellets flow through a water drainage port with washing water, and are collected by a water drainage valve.

14. The control method according to claim 13, wherein in the process of draining water, the inner drum rotates so that cleaning pellets clamped between the walls of the inner and outer drums fall into the chamber between the inner and outer drums, and flow through the water drainage port with water in the outer drum, and are collected by the water drainage valve.

15. The control method according to claim 14, wherein in the process of draining water, the inner drum rotates at a low rotational speed of about 5 rpm to about 50 rpm.

16. The control method according to claim 13, wherein in the spin-dry process, the inner drum is controlled to carry out at least one braking action so that cleaning pellets clamped between the walls of the inner and outer drums fall into space between the inner and outer drums, and flow through the water drainage port with water thrown from laundry, and are collected by the water drainage valve.

17. The control method according to claim 16, wherein the spin-dry process comprises spinning laundry at a medium speed so that water flushes the cleaning pellets, at least one high speed spin-drying and braking, and spin-drying at a highest rotational speed until the end, wherein time allocated for each action in the stage is determined according to total time of the spin-dry procedure.

18. The control method according to claim 17, wherein in the spin-dry process, water is fed for a set time to increase flushing water flow to assist the cleaning pellets to flow through the water drainage port and enter the water drainage valve.

19. The control method according to claim 16, wherein the spin-dry process comprises the steps of:

a. after water drainage, the inner drum spinning the laundry at a medium speed for about 10 to about 60 seconds, or repeating the actions for about 2 to about 8 times according to a rule of rotating at a medium speed for about 2 to about 5 seconds and stopping for about 5 to about 15 seconds, to throw most water out of the laundry, to flush the pellets left at the bottom of the outer drum to the water drainage valve;

b. the inner drum stopping in about 10 to about 20 seconds after accelerating to a high speed to shake off the pellets clamped at the bottom of the inner drum;

c. repeating step (b) for about 1 to about 6 times; and d. spin-drying at a highest rotational speed until the end.

20. The control method according to claim 19, wherein if the amount of the washed laundry is lower than a set value, step (c) is replaced by feeding water for about 5 to about 15 seconds, repeating step (a), and then repeating step (b).

21. The control method according to any one of claim 19, wherein in the spin-dry process, the medium speed is in a range of about 200 rpm to about 500 rpm, the high speed is in a range of about 500 rpm to about 700 rpm, and the highest rotation speed is in a range of about 700 rpm to about 1600 rpm.

* * * * *